United States Patent [19]

Agrawal et al.

[11] Patent Number: 4,994,098

[45] Date of Patent: Feb. 19, 1991

[54] PRODUCTION OF OXYGEN-LEAN ARGON FROM AIR

[75] Inventors: Rakesh Agrawal, Allentown; Donald W. Woodward, New Tripoli, both of Pa.

[73] Assignee: Air Products and Chemicals, Inc., Allentown, Pa.

[21] Appl. No.: 474,431

[22] Filed: Feb. 2, 1990

[51] Int. Cl.[5] ..... F25J 3/04

[52] U.S. Cl. ..... 62/22; 55/66; 62/24

[58] Field of Search ..... 62/22, 24; 55/66

[56] References Cited

U.S. PATENT DOCUMENTS

| | | | |
|---|---|---|---|
| 3,079,759 | 3/1963 | Schilling | 62/22 |
| 3,127,260 | 3/1964 | Smith | 62/22 |
| 3,729,943 | 5/1973 | Petit | 62/22 |
| 4,871,382 | 10/1989 | Thorogood et al. | 62/24 |

FOREIGN PATENT DOCUMENTS 1416820 of 1988 U.S.S.R. .

OTHER PUBLICATIONS

R. E. Latimer, "Distillation of Air", Chem. Engr. Prog. No. 63 (2), pp. 35-59, [1967].

M. Ruhemann, "separation of Gases", Second Edition, p. 223, [1949].

*Primary Examiner*—Ronald C. Capossela

*Attorney, Agent, or Firm*—Willard Jones, II; James C. Simmons; William F. Marsh

[57] ABSTRACT

The present invention is an improvement to a method of producing crude argon directly from the cold box of a cryogenic air separation unit. The improvement is the production of crude argon containing greatly decreased concentrations of oxygen, i.e. <0.5% oxygen without any loss in recovery. The improvement is accomplished by using an effective number of theoretical stages in the side arm column so as to produce the desired argon product purity without sacrificing argon recovery; feeding crude liquid oxygen from the bottom of the high pressure column to the reboiler condenser located in the top of the argon side arm column at a rate in the range from about 1.04 to about 1.36 times the theoretical minimum flow of crude liquid oxygen necessary to completely vaporize that minimum flow of crude liquid oxygen to its dew point; and effectuating the intimate contact between the vapor and liquid phases in the argon side arm column by a combination of conventional sieve trays and low pressure drop, structured packings so that the pressure drop across this combination results in a pressure at the top of the argon side arm column such that the flow of crude liquid oxygen to the reboiler/condenser located in the top of the side arm column can be maintained in the appropriate range. Furthermore, the improvement is accomplished without an energy penalty in the cryogenic air separation unit.

3 Claims, 7 Drawing Sheets

PRODUCTION OF OXYGEN-LEAN ARGON FROM AIR

TECHNICAL FIELD

The present invention relates to a process for the separation of air into its constitutent components by means of cryogenic distillation. More specifically, the present invention relates to a process for the production of crude argon directly from the cold box of the cryogenic distillation unit.

BACKGROUND OF THE INVENTION

Argon is recoverable from sources such as air and $NH_3$ purge gas. Most argon is produced as a crude product from cryogenic air separation units because it is comparatively economical. However, the typical concentration of oxygen in crude argon produced by cryogenic air separation unit is 2–5%, whereas most of the argon uses require nearly oxygen-free argon. This leads to expensive downstream processing of crude argon to reduce its oxygen content. It is desirable to directly produce an argon stream from a cryogenic air separation unit in high recoveries with decreased oxygen content so that either it could be directly used by the users or minimize the processing required to further purify it.

Historically, most of the cryogenic air separation unit use a double distillation column of Linde-type with an argon sidearm column to recover argon from air, as disclosed in Latimer, R. E., "Distillation of Ar", Chemical Engineering Progress, 63 (2), 35–59 [1967]. FIG. 1 shows such a scheme. A carbon dioxide and water free compressed air stream is cooled and fed to a high pressure distillation column. This distillation column produces two liquid streams. The liquid nitrogen stream provides reflux for the top of the low pressure distillation column. The crude liquid oxygen stream from the bottom of the column is split into two fractions. One fraction is fed to the low pressure column as intermediate reflux. The other fraction is vaporized in the overhead reboiler/condenser of argon sidearm column and is fed to the low pressure column a few trays below where the crude liquid oxygen is fed in. The low pressure column produces gaseous nitrogen product, oxygen product and a waste nitrogen stream. An argon-rich (7–12% argon) vapor stream is withdrawn from the low pressure column, many trays below the vaporized crude oxygen feed point and is fed into the bottom of crude argon distillation column with a reboiler/condenser at the top. The nitrogen concentration of this argon-rich stream is typically very low (0.01 to 0.1% nitrogen). The vaporization of a portion of the crude oxygen liquid in the top reboiler/condenser nearly totally condenses the vapor rising to the top of the argon sidearm column, causing the condensate to flow down through the column, thereby providing the needed reflux. The argon available from the air is drawn as crude argon containing 2–5% oxygen from the top of the argon sidearm column.

Since argon is a valuable product, its recovery is often maximized by optimizing the number of theoretical stages in each section of the low pressure and argon sidearm columns and also the flowrates of various streams. The optimization of these theoretical stages goes hand-in-hand with the fact that since early 1930's sieve trays have been the trays of choice for cryogenic air separation unit. These sieve trays have certain contact efficiency and pressure drop per tray. The ratio of these parameters is the pressure drop ($\Delta P$) per theoretical stage (or equilibrium stage). The total pressure drop available for operation of the argon sidearm column limits the number of theoretical stages which can be used in it. The relative volatility of the argon with respect to oxygen ($\alpha$) is about 1.5 at the bottom of argon sidearm column but is only about 1.1 at the top of this column. This low value of $\alpha$ at the top of the column makes it difficult to produce crude argon with low concentrations of oxygen in high recoveries.

As stated by Ruhemann, "we must consider that a high yield of argon is profitable as well as high argon concentration in the final product. Unfortunately these two conditions are irreconcilable." (see Ruhemann, M. "Separation of Gases", Second Edition, pp 223, Oxford University Press, 1949). This irreconcilable notion has plagued the cryogenic air separation industry (which uses sieve trays in its distillation columns) for quite a while; as a result, it has generally chosen a higher recovery (yield) of argon with significantly higher than desired concentrations of oxygen.

This oxygen-containing argon (crude argon) is then further purified in a catalytic reaction unit. In the first step of this purification scheme, crude argon is mixed with hydrogen and passed through a catalytic unit to react the oxygen to form water.

Recently, a process to produce a crude argon stream with lower concentrations of oxygen using sieve trays was disclosed in Soviet patent application (Belyakov V. P., et al., SU 1416820-A, 1988). In this patent application, the limitation of the total number of theoretical stages due to the total pressure drop available in the argon sidearm column is overcome by breaking this column in two zones. The first zone of this column contains enough sieve trays so that the pressure at the top is reduced to atmospheric. The gas stream from this zone upper part is warmed in a heat exchanger, compressed, cooled and fed at the bottom of the second zone of the side arm column. The oxygen enriched liquid stream from the lower part of the second zone is returned under pressure to the upper part of the first zone. An argon stream containing lower concentrations of oxygen is withdrawn from the top of the second zone. The problem with this arrangement is that it needs more capital for extra heat exchangers and a compressor. Furthermore, the use of a compressor increases the power consumption of the process.

SUMMARY OF THE INVENTION

The present invention is an improvement to a process for the separation of air by cryogenic distillation to produce a crude argon product. In the process, the separation is carried out in a multiple distillation column system containing a high pressure column, a low pressure column and an argon sidearm column; a crude argon product is produced at the top of the argon sidearm column; at least a portion of crude liquid oxygen produced at the bottom of the high pressure column is fed to a reboiler/condenser located at the top of the argon sidearm column to provide refrigeration for condensing at least a portion of the crude argon thereby providing reflux for the argon sidearm column; a gaseous argon-oxygen containing side stream is removed from an intermediate location of the low pressure column and fed to the bottom of the argon sidearm column for rectification; and the argon sidearm column a liquid phase and a vapor phase are intimately contacted to effectuate mass transfer to and from the liquid and vapor phases. The improvement for the production of low oxygen content argon having an oxygen concentration of less than or equal to 0.5 mol percent directly from the argon side arm column while maximizing argon recovery comprises three steps. First, an argon sidearm column is used which has an effective number of theoretical stages so as to produce a particular crude argon product purity without sacrificing argon recovery. Second, the crude liquid oxygen is fed from the bottom of the high pressure column to the reboiler condenser located in the top of the argon side arm column at a rate in the range from about 1.04 to about 1.36 times the theoretical minimum flow of crude liquid oxygen necessary to completely vaporize that minimum flow of crude liquid oxygen to its dew point. Third, the argon sidearm column is operated so as to achieve a pressure at the top of the argon side arm column such that the flow of crude liquid oxygen to the reboiler/-condenser located in the top of the side arm column falls within the range from about 1.04 to about 1.36 times the theoretical minimum flow of crude liquid oxygen necessary to completely vaporize that minimum flow of crude liquid oxygen to its dew point.

This third step can be accomplished in two ways. The preferred method is to effectuate the intimate contact between the vapor and liquid phases in the argon side arm column by use of a combination of conventional sieve trays and low pressure drop, structured packing so that pressure drop across the combination results in a pressure at the top of the argon side arm column such that the flow of crude liquid oxygen to the reboiler/-condenser located in the top of the side arm column falls within the range from about 1.04 to about 1.36 times the theoretical minimum flow of crude liquid oxygen necessary to completely vaporize that minimum flow of crude liquid oxygen to its dew point.

An alternative method is to effectuate the intimate contact between the vapor and liquid phases in the argon side arm column by use of low pressure, structured packing and reducing the pressure of the argon-/oxygen side stream fed to the argon sidearm column so that the combination of the pressure drop across the low pressure, structured packing and the reduction of pressure of the argon/oxygen side stream fed to the argon sidearm column result in a pressure at the top of the argon side arm column such that the flow of crude liquid oxygen to the reboiler/condenser located in the top of the side arm column falls within the range from about 1.04 to about 1.36 times the theoretical minimum flow of crude liquid oxygen necessary to completely vaporize that minimum flow of crude liquid oxygen to its dew point.

DETAILED DESCRIPTION OF THE INVENTION

The present invention is an improvement to a process for the cryogenic distillation of air to produce nitrogen, oxygen and argon products. Typically, these processes use a cryogenic distillation system which comprise three distillation columns: a high pressure column, a low pressure column and an argon sidearm column, which utilize conventional trays to effectuate intimate contact between the vapor and liquid phases in the columns.

Figure 1:
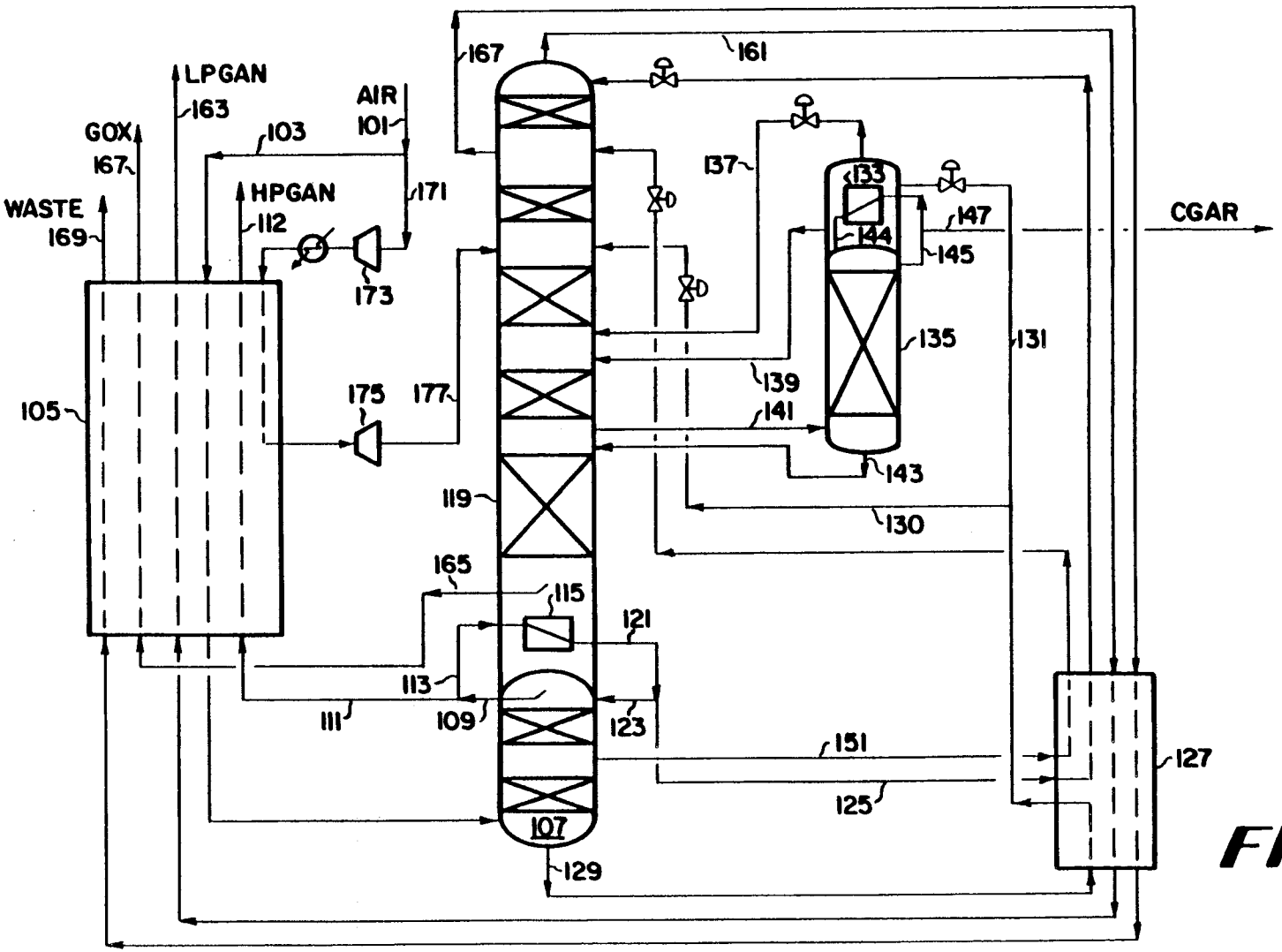
FIG. 1 is a schematic diagram of a cryogenic air separation process for the production of a crude argon product.

To better understand the present invention, it is important to understand the background art. As an example, a typical process for the cryogenic separation of air to produce nitrogen, oxygen and argon products using a three column system is illustrated in FIG. 1. With reference to FIG. 1, a clean, pressurized air stream is introduced into the process, via line 101. This clean, pressurized air stream is then divided into two portions, lines 103 and 171, respectively. The first portion is cooled in heat exchanger 105 and fed to high pressure distillation column 107, via line 103, wherein it is rectified into a nitrogen-rich overhead and a crude liquid oxygen bottoms. The nitrogen-rich overhead is removed from high pressure distillation column 107, via line 109, and split into two substreams, lines 111 and 113, respectively. The first substream in line 111 is warmed in heat exchanger 105 and removed from the process as high pressure nitrogen product, via line 112. The second portion, in line 113, is condensed in reboiler/condenser 115, which is located in the bottoms liquid sump of low pressure distillation column 119, and removed from reboiler/condenser 115, va line 121, and further split into two parts. The first part is returned to the top of high pressure distillation column 107, via line 123, to provide reflux; the second part, in line 125, is subcooled in heat exchanger 127, reduced in pressure and fed to top of low pressure distillation column 119 as reflux.

The crude liquid oxygen bottoms from high pressure distillation column 107 is removed, va line 129, subcooled in heat exchanger 127, and split into two sections, lines 130 and 131, respectively. The first section in line 130 is reduced in pressure and fed to an upper-intermediate location of low pressure distillation column 119 as crude liquid oxygen reflux for fractionation. The second section in line 131 is reduced in pressure, heat exchanged with crude argon vapor overhead from argon sidearm distillation column 135 wherein it is partially vaporized. The vaporized portion is reduced in pressure and fed to an intermediate location of low pressure distillation column 119, via line 137 for fractionation. The liquid portion is fed, via line 139, to an intermediate location of low pressure distillation column 119 for fractionation.

An argon-oxygen-containing side stream is removed from a lower-intermediate location of low pressure distillation column 119 and fed, via line 141, to argon sidearm distillation column 135 for rectification into a crude argon overhead stream and a bottoms liquid which is recycled, via line 143, to low pressure distillation column 119. The crude argon overhead stream is removed from argon sidearm distillation column 135, via line 145; has a crude gaseous argon product stream removed, via line 147, and is then fed to reboiler/condenser 133, where it is condensed against the second section of the subcooled, high pressure distillation column, crude liquid oxygen bottoms. The condensed crude argon is returned to argon sidearm distillation column 135, via line 144, to provide reflux. Alternatively, crude liquid argon could be removed as a portion of line 144.

The second portion of the feed air, in line 171, is compressed in compressor 173, cooled in heat exchanger 105, expanded in expander 175 to provide refrigeration and fed, via line 177, to low pressure distillation column 119 at an upper-intermediate location. Also as a feed to low pressure distillation column 119, a side stream is removed from an intermediate location of high pressure distillation column 107, via line 151, cooled in heat exchanger 127, reduced in pressure and fed to an upper location of low pressure distillation column 119 as added reflux.

To complete the cycle, a low pressure nitrogen-rich overhead is removed, via line 161, from the top of low pressure distillation column 119, warmed to recover refrigeration in heat exchangers 127 and 105, and removed from the process as low pressure nitrogen product, via line 163. An oxygen-enriched vapor stream is removed, via line 165, from the vapor space in low pressure distillation column 119 above reboiler/condenser 115, warmed in heat exchanger 105 to recover refrigeration and removed, via line 167, from the process as gaseous oxygen product. Finally, an upper vapor stream is removed from low pressure distillation column 119, via line 167, warmed to recover refrigeration in heat exchangers 127 and 105 and then vented from the process as waste, via line 169.

The improvement for the production of low oxygen content argon directly from the argon side arm column while maximizing argon recovery comprises the following steps:

First, a argon sidearm column is used which has an effective number of theoretical stages so as to produce argon with an oxygen concentration of less than or equal to 0.5 mol% without sacrificing argon recovery. This effective number of theoretical stages is higher than the number conventionally used; the conventional number of stages typically used in an argon sidearm column is 30 to 50.

Second, crude liquid oxygen is fed from the bottom of the high pressure column to the reboiler/condenser located in the top of the argon side arm column at a rate in the range from about 1.04 to about 1.36 times the theoretical minimum flow of crude liquid oxygen. This theoretical minimum flow of crude liquid oxygen s defined as the flow of crude liquid oxygen to the reboiler/condenser at the top of the argon sidearm column such that it is completely vaporized by the condensing argon stream and leaves the reboiler/condenser as a vapor stream at its dew point. This feed rate of crude liquid oxygen to the reboiler/condenser optimizes that fraction of crude liquid oxygen bottoms from the high pressure distillation column which is fed directly to an upper-intermediate location of the low pressure distillation column. This direct feed to the low pressure distillation column acts as a impure reflux and increases argon recovery from the low pressure distillation column to the argon sidearm column without sacrificing argon recovery in the argon sidearm column.

Third, the argon sidearm column is operated so as to achieve a pressure at the top of the argon sidearm column such that the flow of crude liquid oxygen to the reboiler/condenser located in the top of the side arm column falls within the range from about 1.04 to about 1.36 times the theoretical minimum flow of crude liquid oxygen necessary to completely vaporize that minimum flow of crude liquid oxygen to its dew point. This third step can be achieved in two ways. The preferable way is to effectuate the intimate contact between the vapor and liquid phases in the argon side arm column by the use of a combination of conventional sieve trays and low pressure drop, structured packings so that the pressure drop across this combination results in a pressure at the top of the argon side arm column such that the flow of crude liquid oxygen to the reboiler/condenser located in the top of the side arm column falls within the range from about 1.04 to about 1.36 times the theoretical minimum flow of crude liquid oxygen necessary to completely vaporize that minimum flow of crude liquid oxygen to its dew point. An alternative way is to effectuate the intimate contact of the vapor and liquid phases in the argon sidearm column using a low pressure, structured packing in the entire argon sidearm column and reducing the pressure of the feed to the argon sidearm column so that the combination of the pressure drop across the packing and the reduction in pressure of the column feed results in a pressure at the top of the argon side arm column such that the flow of crude liquid oxygen to the reboiler/condenser located in the top of the side arm column falls within the range from about 1.04 to about 1.36 times the theoretical minimum flow of crude liquid oxygen necessary to completely vaporize that minimum flow of crude liquid oxygen to its dew point.

Figure 2:
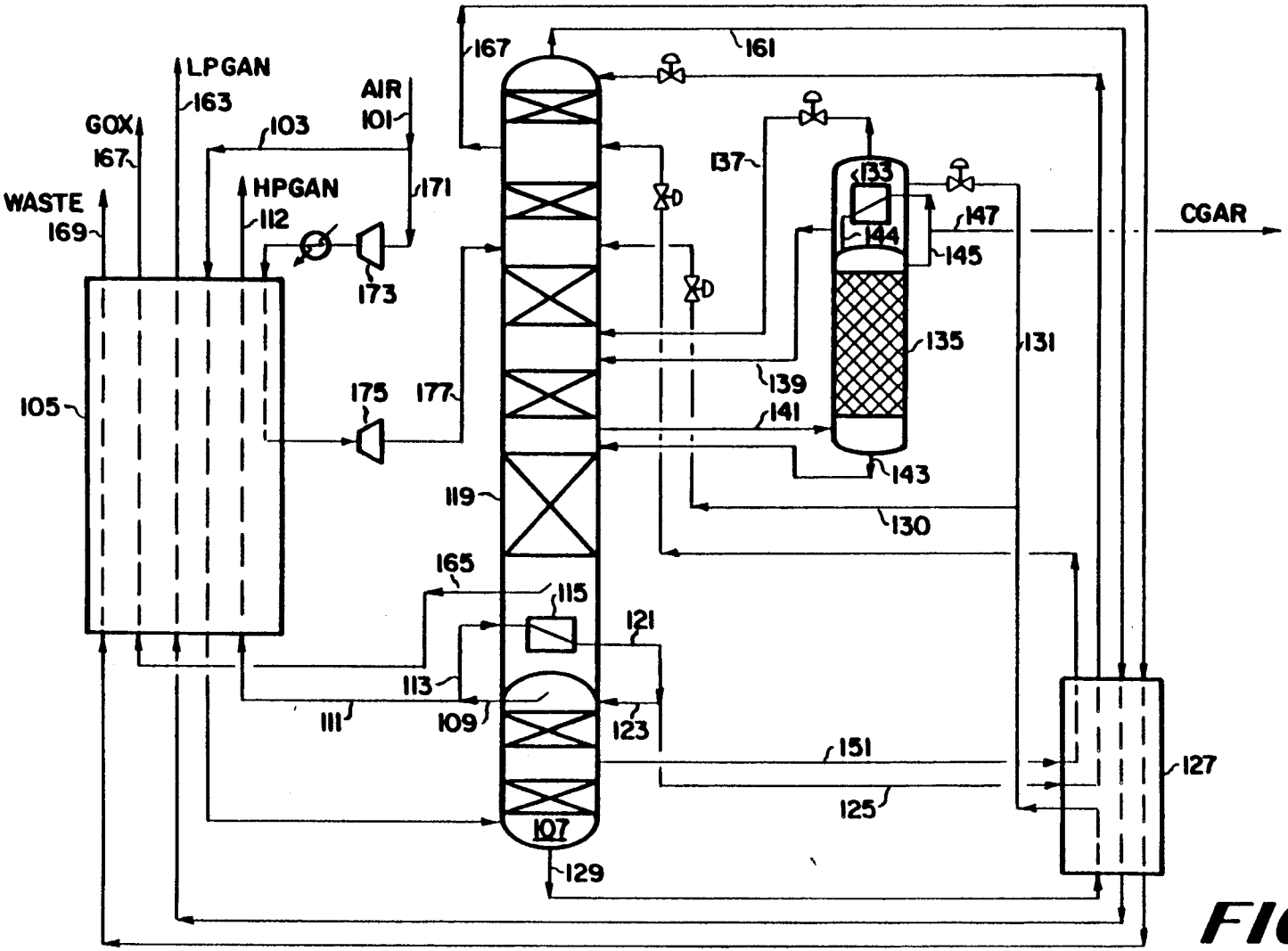
FIG. 2 is a schematic diagram of the cryogenic ar separation process shown in FIG. 1 with the packing section of the argon sidearm column highlighted.

As it will be shown later, these steps which comprise the improvement produces a crude argon with significantly lower concentrations of oxygen without a significant decrease in argon recovery. This achievement is in direct contrast with the industry's current experience where a sharp drop in argon recovery is observed with decreased oxygen concentration in crude argon. An embodiment of the present invention is shown in FIG. 2, which in essence is identical to FIG. 1 but for the cross-hatching shown to indicate the combination of conventional sieve trays and low pressure drop, structured packing in the argon sidearm distillation column 135.

To better understand the present invention, the term "low pressure drop, structured packing" means a packing which will promote liquid and/or vapor mixing in a direction perpendicular to the primary flow direction and in doing so will have a small pressure drop across per unit length in the flow direction. Examples of structured packings are well known in the art. It should be noted that it is not the intention of the present invention to prefer one structured packing over another.

The following examples will illustrate the efficacy of the present invention:

EXAMPLES

Example 1: The process shown in FIG. 1 was simulated using conventional sieve trays in all three distillation columns. The assumptions of the simulations are that only gaseous products would be produced. No liquid products would be produced. Gaseous nitrogen from the top of low pressure column would be recovered from the cold box at 16 psia which is close to ambient pressure of 14.7 psia. Recovery of gaseous oxygen and gaseous crude argon would be maximized for a given feed air flow to the cold box. About 14% of feed air would be produced as nitrogen-rich waste stream to regenerate the adsorbents used at the front end to remove $H_2O$ and $CO_2$ from the compressed feed air.

A portion of the feed air is compressed in a booster driven by the turbine would be used to provide refrigeration to the cold box, cooled with cooling water and then fed to the main heat exchangers in the cold box. This boosted air is expanded in an turbine would provide the needed refrigeration and then be fed to the low pressure column. For a given number of theoretical stages in the distillation columns, this technique is known to improve argon recovery as compared to the conventional process where expanded ar is not boosted prior to expansion.

A typical number of theoretical stages were used in all the three distillation columns. The number of theoretical stages in the argon sidearm column for this example, defined in this application as 100% of theoretical stages, was 44 actual theoretical stages. The amount of crude liquid oxygen fed to the reboiler/condenser at the top of the argon sidearm column was chosen so that the minimum temperature difference ($\Delta T$) between the boiling fluid and the condensing stream was 2.7° F.

The simulation showed that the crude argon product which would be produced from the simulated process would have an oxygen concentration of 2.5% and an argon recovery of 92.2%. Argon recovery is defined as percent of argon in the feed air to the distillation columns which is contained in the crude argon product.

Example 2: Further simulations were made for the case in Example 1 to produce a crude argon stream with half the concentration of oxygen. The number of theoretical stages in the form of sieve trays were kept same in all the three distillation columns as in Example 1.

The simulation showed that a crude argon product having an oxygen concentration of 1.25% could be produced, however, argon recovery would drop to 80.5%.

Example 3: One of the problems with the process of Example 2 is that the relative volatility of argon with respect to oxygen ($\alpha$) is only about 1.1 near the top of the argon sidearm column and this makes it difficult to reduce the oxygen concentration in crude argon without sacrificing a large fraction of recovery. Textbooks on distillation teach that increasing the number of theoretical stages in the distillation columns will achieve higher recovery and product purities. Therefore, it would be logical to increase the number of theoretical stages in the argon sidearm column to increase argon recovery, while achieving lower concentrations of oxygen in the crude argon. To this end, a process was simulated keeping the same number of sieve trays in the low pressure and high pressure columns as in Example 1, but increasing the number of sieve trays in the argon sidearm column by 48%, thus, resulting in 65 actual number of theoretical stages in the argon sidearm column. Once again, the recovery of oxygen and argon would be maximized.

The results of this simulation showed that a crude gaseous argon product containing 0.5% oxygen would be produced at an argon recovery of 91.3%. One should note that this argon recovery is lower than 92.2% obtained in Example 1.

Additionally, one should know that when compared to Example 1 the amount of crude liquid oxygen fed to the reboiler/condenser at the top of the argon sidearm column is now much higher (51.2 moles vs. 33 moles in Example 1). This increase is due to the fact that the pressure of the condensing fluid is 14.7 psia which is lower than 16.84 psia of Example 1. In both these examples, pressure at the bottom of the argon sidearm column is same (21.4 psia) but the larger number of sieve trays in this example leads to a much reduced pressure at the top of this column. The lower pressure of the condensing fluid requires that the temperature of the boiling fluid in the reboiler/condenser also be lower; this requirement is met by increasing the flow of crude liquid oxygen to the boiling side of the reboiler/condenser. The liquid fraction exiting the reboiler/condenser increases with crude liquid oxygen feed to this reboiler/condenser thereby causing a lower boiling temperature.

To further the argument, even if a vacuum could be tolerated at the top of the argon sidearm column, more trays cannot be added to this column to further decrease oxygen concentration in crude argon because virtually all the crude liquid oxygen from the bottom of the high pressure column has already been utilized and therefore it is nearly impossible to further reduce the temperature of the boiling fluid. So, f attempts were to be made in FIG. 1 to decrease oxygen concentration in crude argon below 0.5% using sieve trays, a severe penalty in recovery similar to Example 2 will follow. In fact, an attempt to produce 0.2% oxygen containing argon from this column reduces the argon recovery to 52.7%.

Example 4: The simulation of Example 3 was repeated with all the sieve trays in the argon sidearm column being replaced with a low pressure drop structured packing; see FIG. 2. Thus, all the 148 theoretical stages are now structured packing (65 actual number of theoretical stages as packing). Since structured packing has low pressure drop, a reasonable pressure drop was taken across a valve in the line feeding argon containing vapor from the low pressure column to the argon sidearm column such that pressure at the top of the argon sidearm column was 16.4 psia. The simulations showed that the a crude gaseous argon product containing 0.5% oxygen can be produced at an argon recovery of 92.1%, this is the same as in Example 1. Thus, the conventional wisdom that one has to sacrifice argon recovery substantially in order to reduce oxygen concentration in crude argon product is incorrect.

Figure 3:
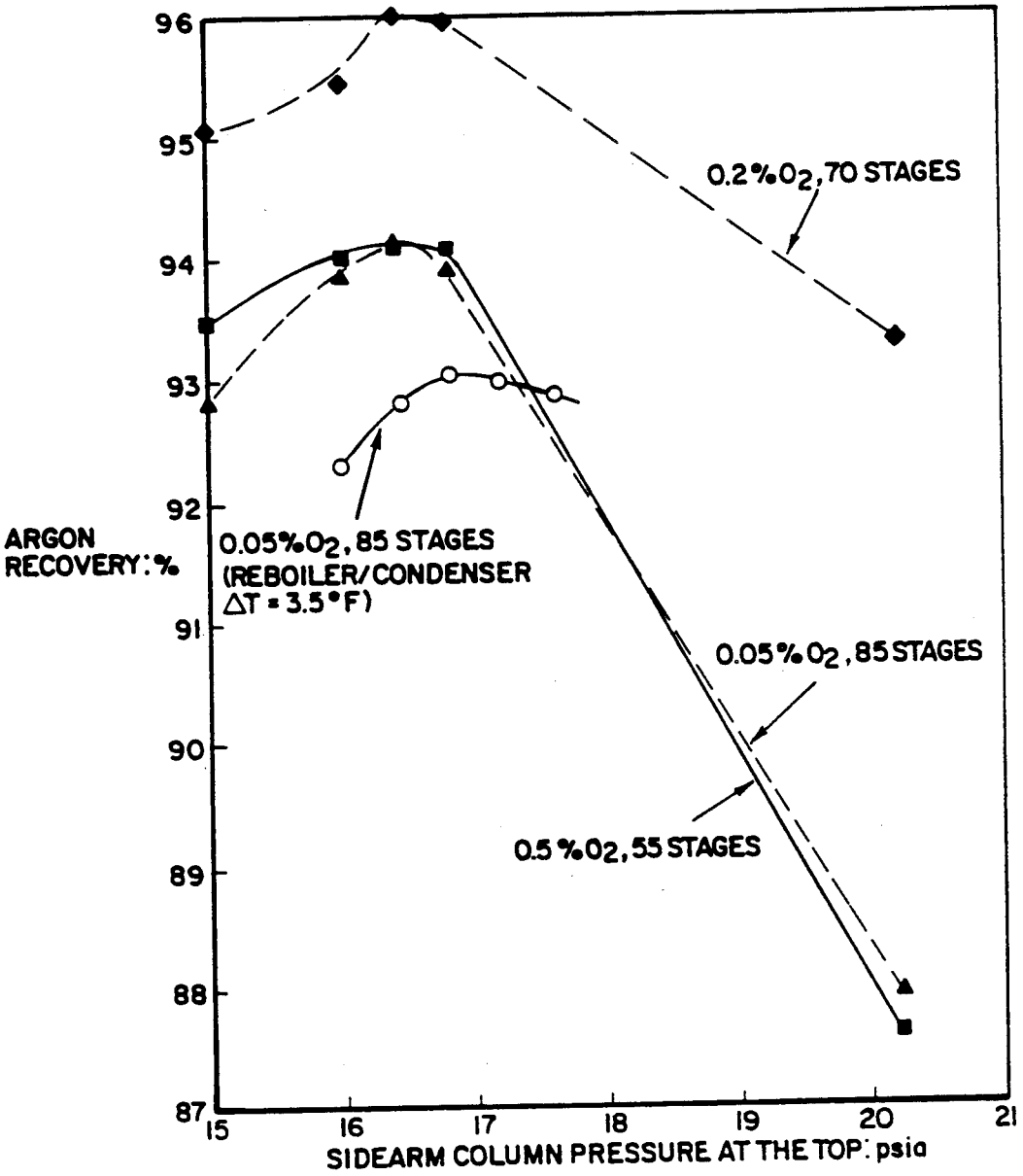
FIG. 3 is a plot showing the effect of the pressure at the top of the argon sidearm column on argon recovery.
Figure 4:
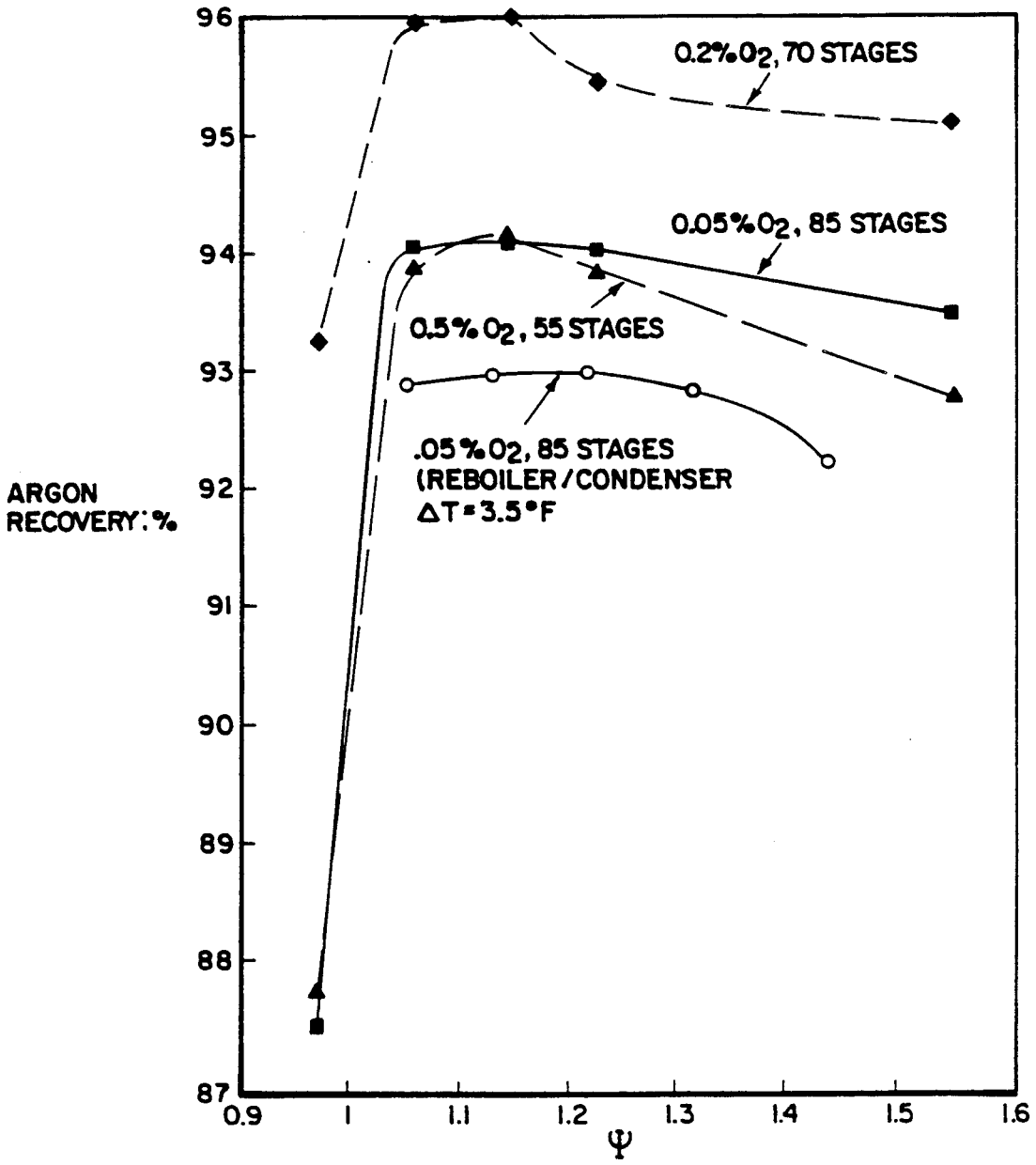
FIG. 4 is a plot showing the effect of crude liquid oxygen flow to the reboiler/condenser at the top of the argon sidearm column on argon recovery.

Example 5: Simulations of the process of Example 4 were repeated such that pressure at the top of the argon sidearm column was varied from 15 psia to about 20 psia. Additionally, the effect of the feed rate of crude liquid oxygen to the reboiler/condenser at the top of the argon sidearm column was investigated. Argon recovery versus pressure at the top of the argon sidearm column for various cases is shown in FIG. 3. Argon recovery versus crude liquid oxygen feed to the reboiler/condenser at the top of the argon sidearm column for various cases, reported as the ratio of actual crude liquid oxygen fed to the condenser to the theoretical minimum amount of crude liquid oxygen which would be needed in order such that it would be completely vaporized to its dew point, is shown in FIG. 4. In FIG. 4, the foregoing described ratio is denoted by the symbol $\Psi$. In FIGS. 3 and 4, unless otherwise shown, the ΔT across the reboiler/condenser at the top of the sidearm column for all curves shown is 2.75° F. With the use of structured packing, one can vary the pressure at the top of the argon sidearm column in two ways:

Change the pressure drop across the valve in the line feeding argon containing stream from the low pressure column to the argon sidearm column. A higher pressure drop across this valve will result in a lower pressure at the top of the argon sidearm column.

Take minimal pressure drop across this valve but use some sieve trays in the argon sidearm column along with structured packing. The use of some sieve trays will provide the extra pressure drop needed to adjust the pressure at the top of the argon sidearm column to maximize argon recovery. The sieve trays could be used anywhere in the argon sidearm column but the bottom section of the column is preferred. Generally, cost of the sieve trays per theoretical stage is cheaper than the structured packing and therefore, these hybrid columns, whenever possible to use, would be preferred.

The results shown in FIG. 3 are interesting because it shows that a maximum in argon recovery exists with pressure at the top of the argon sidearm column. The nature of this curve will be a function of the pressure of the low pressure column. If the low pressure column were to be run at an elevated pressure, the pressure at the top of the argon sidearm column will have to be optimized accordingly.

Normally, one expects the separation to be better when the pressure in a distillation column is low, owing to the fact that a reduction in pressure causes an increase in the relative volatilities (α) of the components. Yet in FIG. 3, the recovery of argon for Example 3, where all sieve trays are used (pressure at the top of the argon sidearm column of 15 psia), is lower than for the cases where at least a part of the argon sidearm column is packed with the low pressure drop structured packing.

The results shown in FIG. 4 are also interesting because it shows that an optimum actual crude liquid oxygen flow to the reboiler/condenser at the top of the argon sidearm column exists. In FIG. 4, the amounts of crude liquid oxygen to the argon sidearm column reboiler/condenser is reported as the ratio of actual crude liquid oxygen fed to the condenser to the theoretical minimum amount of crude liquid oxygen which would be needed in order such that it would be completely vaporized to its dew point. This ratio is less that 1.0 when the crude liquid oxygen is superheated in the reboiler/condenser.

What this figure shows is that for a particular reboiler/condenser ΔT, regardless of the purity and number of stages, the maximum argon recovery occurs within a pressure range at the top of the argon sidearm column and hence a range of ratios of actual to theoretical crude liquid oxygen feed rates. Amazingly, this ratio, regardless of the reboiler/condenser ΔT, occurs in the same range. That range is from about 1.04 to about 1.36.

Thus, it appears that the use of a low pressure, structured packing in sections of the argon sidearm column not only allows increasing the number of stages in the column to achieve higher argon purities but it also permits the adjustment of the pressure at the top of this column to maximize the argon recovery.

Example 6: In this example, the number of theoretical stages in the low pressure and high pressure columns were kept the same as in the earlier examples but the number of theoretical stages in the argon sidearm column were increased over a wide range and the results are shown in FIG. 5.

This increase in number of theoretical stages is only possible when low pressure drop structured packings are used in part of this column. This is due to the fact that for given pressure of the products from the top of low pressure column (low pressure gaseous nitrogen and/or nitrogen-rich waste stream pressure), the constant number of trays in the low pressure column fixes to some extent the pressure of the argon containing stream withdrawn from the low pressure column to be fed at the bottom of the argon sidearm column for further separation. The number of sieve trays used with conventional pressure drops per theoretical stages is thus limited by the total pressure difference between the pressure of this feed stream to the argon sidearm column and the ambient pressure. This is because it is undesirable to have any part of a cryogenic distillation column operating below ambient pressure. Therefore, the lowest pressure at the top of the argon sidearm column is the ambient pressure. For our case, this limit was reached in Example 3 with 148% theoretical stages. Therefore for the current cases of higher number of theoretical stages, at least some packing will have to be used in the argon sidearm column.

Even if vacuum could be tolerated at the top of the argon sidearm column, Examples 3, 4 and 5 clearly demonstrate that it would be beneficial to use some packing and thus keep the pressure at the top of the argon sidearm column at some reasonable value. Furthermore, in Example 3 almost all the crude liquid oxygen from the bottom of the high pressure column was fed to the reboiler/condenser at the top of the crude arm column to meet the required temperature difference between the condensing and boiling fluids; any further decrease in the temperature of the condensing fluid (due to an even lower pressure) will make it nearly impossible to meet the desired temperature difference. These difficulties are easily overcome by using structured packing in the argon sidearm column.

Figure 5:
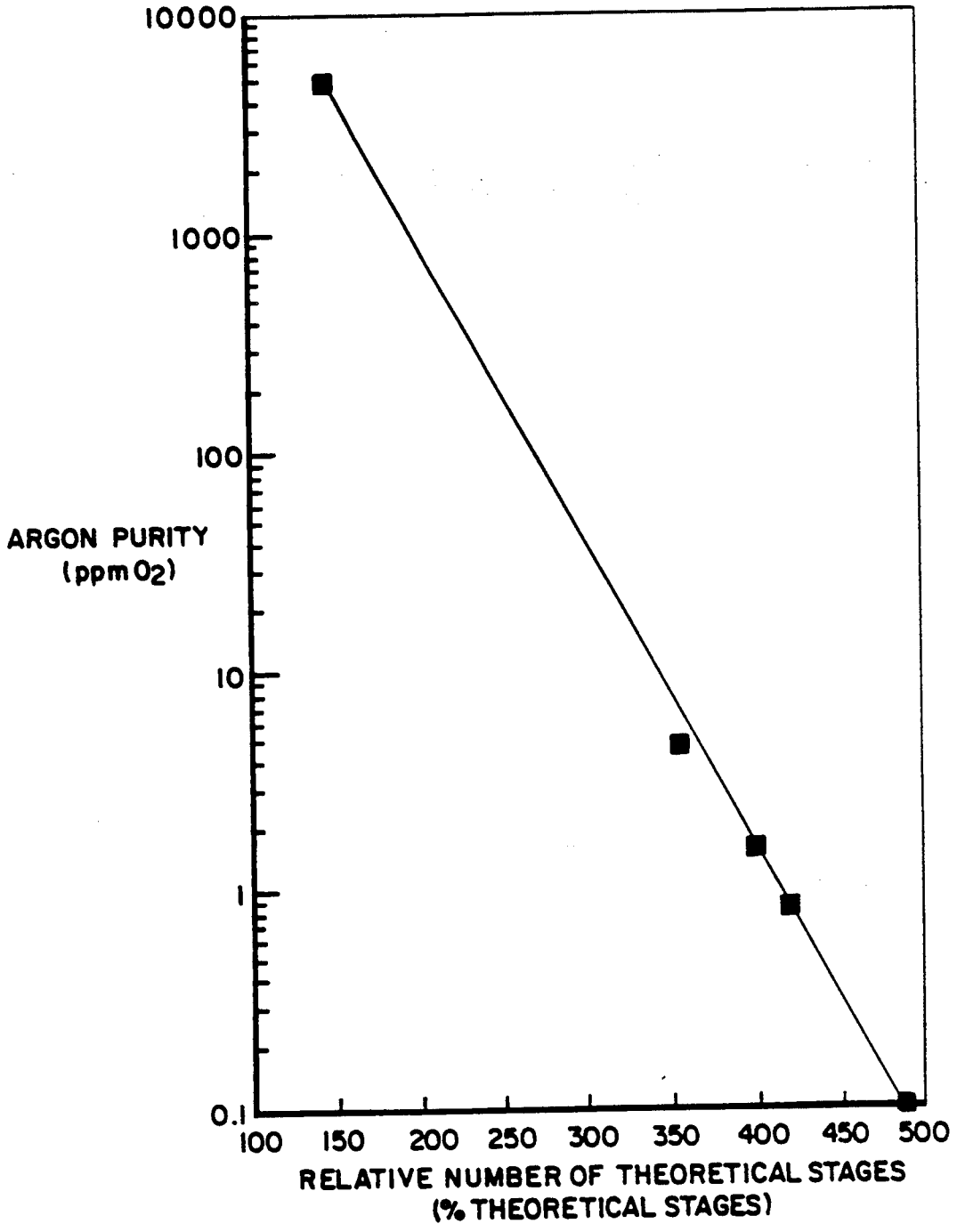
FIG. 5 is a plot of the effect on the number of theoretical stages in the argon sidearm column on argon purity.

In FIG. 5, as the number of theoretical stages were increased, the argon recovery was kept constant, at about 94% and argon with increased purity (with decreased oxygen concentration) was produced. With about 364% theoretical stages (160 actual), oxygen concentration in the argon from the argon sidearm column drops to about 4.5 ppm. By increasing the number of stages it can be dropped to as low as 0.1 ppm (at 500% of theoretical stages and 220 actual number of theoretical stages).

These results are indeed remarkable. Such low concentrations of oxygen in an argon stream by cryogenic distillation have been unheard of and meets most of the product argon specification. This removes and/or minimizes the warm end equipment such as a Deoxo or a getter unit which have almost always been used to remove oxygen from the argon stream by catalytically reacting it with hydrogen.

The addition of more theoretical stages in the form of packing will make the argon sidearm column taller. This column could still be arranged next to the low pressure column so that the liquid leaving this column is fed to the low pressure column by gravity. This will make cold box taller. Alternatively, the argon sidearm column could be lowered so as not to increase the height of the cold box; the liquid leaving the bottom of this column could then be pumped back to the low pressure column.

Figure 6:
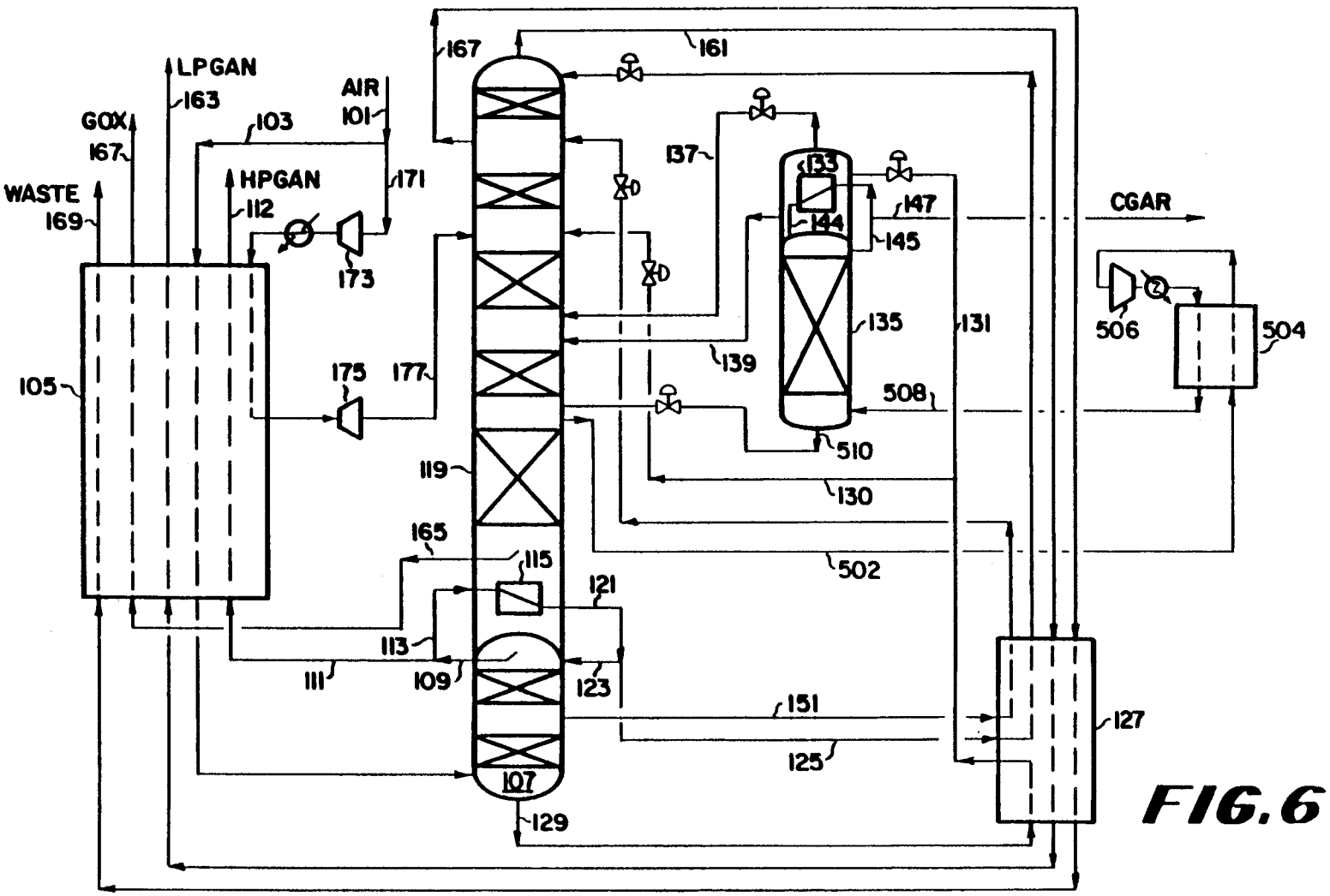
FIG. 6 is a schematic of an alternate process for the production of low oxygen content argon.

Example 7: In an attempt to achieve much lower concentrations of oxygen in the argon stream by using all seven trays instead of packing, a new process was developed as an alternative to processes of FIG. 1 and Belyakov, et al. An improved variation of these processes is shown in FIG. 6. This flowsheet is similar to one in FIG. 1 with the difference that argon containing vapor, in line 502, is removed from low pressure column 119, warmed in heat exchanger 504, boosted in pressure using a compressor 506, cooled and fed, via line 508, to argon sidearm distillation column 119 at a bottom location. Even though Belyakov, et al. do not teach the optimization of the pressure at the top of the sidearm column, in the current simulation, the amount of boosting is such that the pressure at the top of the argon sidearm column is the optimum desirable pressure as taught earlier in this application.

It is worth noting that the booster could be a cold compressor and therefore, the argon containing stream from the low pressure column could be cold compressed. This would eliminate the need for a heat exchanger to warm and then recool this stream. The cold compression will particularly be more attractive when the concentration of oxygen in the argon product stream from the argon sidearm column does not have to be decreased to extremely low values. This will reduce the number of additional trays in this column. Therefore, only a small increase in pressure across the cold compressor to overcome the pressure drop of additional sieve trays will be required. In this case, small consumption of energy in the cold compressor should not affect the performance of the overall plant.

Simulations were done to compare the performance of this plant (FIG. 6) with the one suggested using packing.

Runs were made using 182% theoretical stages to produce an argon stream containing 2000 ppm oxygen (0.2% oxygen). When sieve trays are used in the argon sidearm column of the process in FIG. 6 the argon recovery is slightly lower than the case when all packing is used in the corresponding column of FIG. 1. Moreover, there is an increase in power consumption due to the booster. The power consumption in the booster is 3.3% of the power used in the main air compressor. This power consumption increases rapidly f attempts to produce argon with even lower concentrations of oxygen are made. For the production of 1.3 ppm oxygen, the booster in the process of FIG. 6 consumes 9.3% of the power used in the main air compressor. Whereas, use of structured packing can do this without any additional power consumption.

Thus the use of structured packing in the argon sidearm column allows the production of argon with lower concentrations of oxygen without using extra equipment and power.

Figure 7:
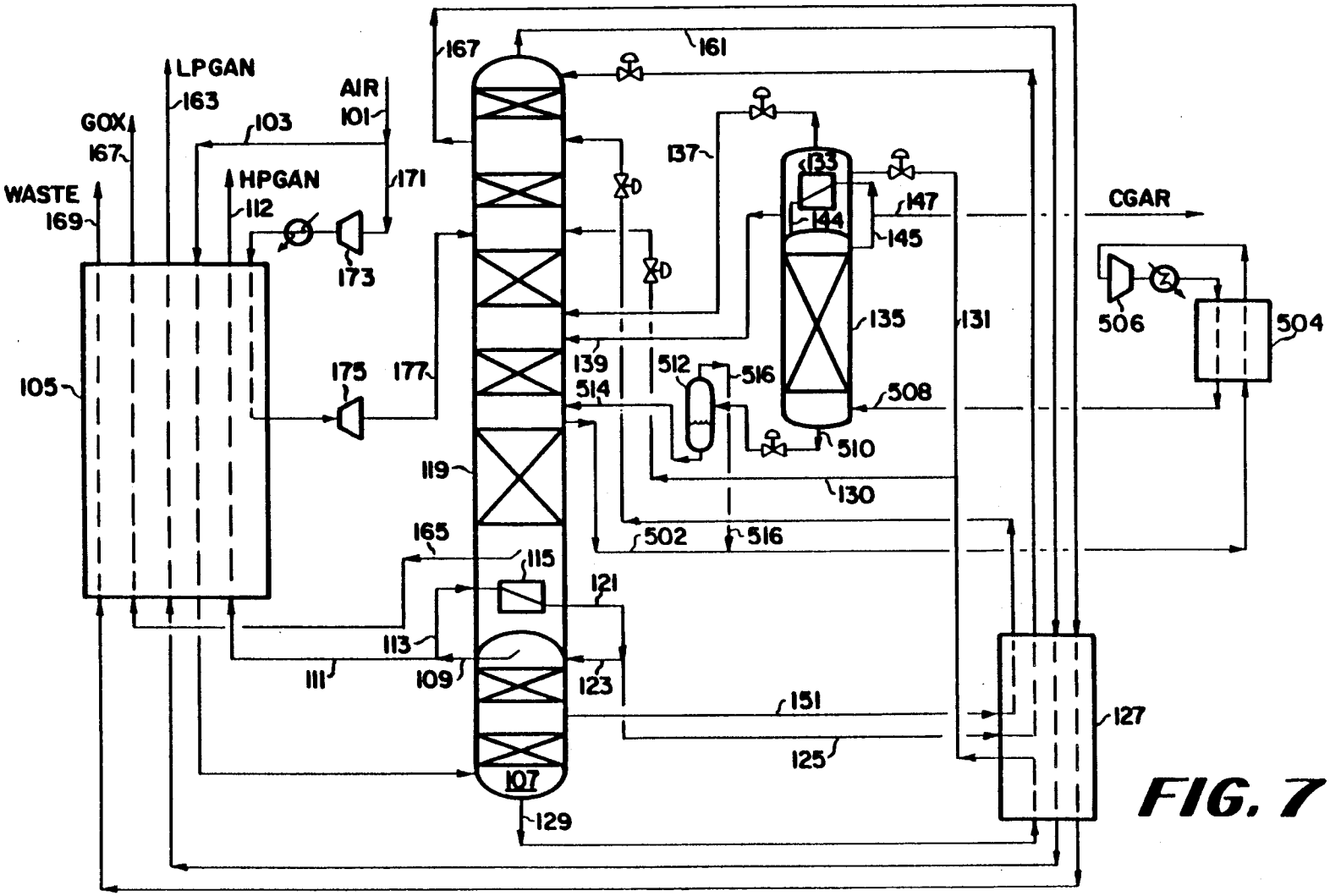
FIG. 7 is a schematic of a variation on the alternate process for the production of low oxygen content argon shown in FIG. 6.

Example 8: The process of FIG. 6 using trays in the argon sidearm column gives a little lower argon recovery. An attempt was made to improve this argon recovery and the result is shown in FIG. 7. The liquid stream from the bottom of the argon sidearm column is now flashed in a separator and the vapor from this separator is recycled to the argon sidearm column by mixing it with the vapor draw from the low pressure column which forms the feed to the argon sidearm column. Now argon recovery is nearly the same as for the case with packing but an incremental power consumption is still there.

It is of further interest to compare the process of FIG. 7 suggested in this document (and used as comparative example for the main invention of packing use) with the idea suggested by Belyakov, et al. Both the ideas use sieve trays and an extra compressor to produce argon containing lower concentrations of oxygen by the cryogenic distillation. The recovery of argon by both the processes would be roughly the same. However, the power consumption by the process of FIG. 7 is significantly lower. Calculations to produce argon containing 2000 ppm oxygen by the process of Belyakov, et al. resulted in power consumption by the booster to be 4.3% of the main air compressor power as compared to 3.3% for the process of FIG. 7. Thus without any increase in argon production, the process of Belyakov, et al. consumes about 1% more power. This is also true for the case when oxygen concentration in argon is about 1.5 ppm. Besides increased energy consumption, it should be pointed out that the process of Belyakov, et al. breaks the aFgon sidearm column in two and will therefore require extra feed distributors.

All the above examples clearly show that the prudent use of a low pressure drop, structured packing in the argon sidearm column can lead to the production of argon stream from the cold box with much reduced concentrations of oxygen. This is achieved without sacrificing argon recovery or requiring incremental power.

Even though all the examples have been presented for gaseous products, the concept s applicable to any cryogenic ASU irrespective of the nature of product. Thus it is applicable to plants producing liquid nitrogen, liquid oxygen, liquid crude argon and/or gaseous products.

In all the above examples, sieve trays were used in low pressure and high pressure columns. The invention is also applicable to cases where either one or both of these columns are at least partially packed with the lower pressure drop packing. For example, any one or more sections of the low pressure column could be packed with structured packing. In some cases, rather than packing all of low pressure column it may be prudent to use sieve trays in at least one section of low pressure column above the feed draw for the argon sidearm column. This will make the pressure of the feed to the argon sidearm column a little higher and allow to use large number of theoretical stages in the argon sidearm column to produce relatively pure argon. The most optimum section in the low pressure column to use sieve trays will be the section between the feed from the reboiler/condenser at the top of the argon sidearm column and the side draw for feeding the argon sidearm column; and the rest of the section in the low pressure column could be packed with structured packing.

As discussed in the examples, in the argon sidearm column, a combination of sieve trays and structured packing can be used to give optimum pressure at the top of the argon sidearm column. This will also be economically more attractive because the cost of structured packing per theoretical stage is slightly higher than the corresponding cost for sieve tray.

One of the advantages of the present invention is that it produces argon with extremely low or negligible concentrations of oxygen. This allows the integration of this system with those oxygen removal processes which were not feasible with the traditional argon production system, such as cryogenic adsorption, chemical absorption, getters and the like.

It has already been discussed that the relative volatility of argon with respect to oxygen is only about 1.1 in the top section of the argon sidearm column. Due to this low value of relative volatility, either a large number of theoretical stages or values of L/V approaching to unity are required to produce crude argon with low concentrations of oxygen. As the value of L/V is increased, more and more liquid as fraction of vapor feed leaves from the bottom of the argon sidearm column and this reduces the argon recovery. On the other hand, for a fixed number of trays in the low pressure column and a fixed pressure of low pressure gaseous nitrogen/-waste product, there exist an upper limit to the number of sieve trays which can be used in the argon sidearm column.

The number of sieve trays in a argon sidearm column is limited by the minimum pressure which can be realized at the top of the argon sidearm column. An increase in number of sieve trays can lead to vacuum at the top of the argon sidearm column, lower than practical temperature difference between the condensing fluid and evaporating crude liquid oxygen in the top reboiler/condenser of the argon sidearm column and to the possibility of argon freeze-up in this reboiler/condenser. All these three effects are undesirable and limit the maximum number of sieve trays which can be used in the argon sidearm column to recover oxygen-lean crude argon.

Furthermore, as seen from Examples 1 and 3, even for cases where the number of sieve trays in the argon sidearm column can be increased, efforts to decrease oxygen concentration in the crude argon can lead to a decrease in its recovery. This results from the fact that as sieve trays are increased in the argon sidearm column, the pressure and therefore the temperature of the condensing argon is reduced, requiring that more crude liquid oxygen be fed in the top reboiler/condenser to provide the lower temperatures needed for condensation. This has an adverse effect on argon recovery beyond some point, i.e., there is an optimum liquid crude oxygen feed to the low pressure column and as this feed is decreased, the recovery of argon decreases. Consequently, for a fixed number of sieve trays in the low pressure column, there is an optimum number of sieve trays in the argon sidearm column to give maximum argon recovery; any attempt to reduce the oxygen content of the crude argon by increasing the number of sieve trays is accompanied by a drop in argon recovery.

Alternatively, the number of sieve trays in the argon sidearm column could be increased by increasing the number of sieve trays in the low pressure column argon section to cause higher pressures at the top of the argon sidearm column. This would lead to higher pressures in the bottom of the low pressure column, which would have an adverse effect on oxygen/argon separation in the bottom of low pressure column, contributing to lower argon recoveries. (Furthermore, this also increases pressure of high pressure column which can have negative effect on the amount and purity of high pressure liquid nitrogen available for reflux to low pressure column. This will again impact argon recovery.) For these reasons, once again an optimum in the number of sieve trays exists, and attempts to increase the number of sieve trays to decrease the oxygen content of crude argon leads to a substantial drop in recovery.

Alternatively if the configurations shown in FIGS. 6 and 7 were to be used to increase number of sieve trays in the argon sidearm column, a substantial cost and energy penalty is incurred. In these configurations, additional equipment is used and excess energy up to 10% of main air compressor power is consumed.

On the other hand, use of low pressure drop structured packing allows an increase in the number of theoretical stages in the argon sidearm column without the above limitations. This allows the production of argon containing much lower concentrations of oxygen with little or no loss n argon recovery. Furthermore, as seen from Example 5, use of structured packing allows adjustment of the pressure at the top of the argon sidearm column to maximize the argon recovery.

The present invention has been described with reference to specific embodiments thereof. These embodiments should not be viewed as a limitation of the scope of the present invention. The scope of the present invention is ascertained by the following claims.

We claim:

1. In a process for the separation of air by cryogenic distillation to produce a crude argon product, wherein the separation is carried out in a multiple distillation column system containing a high pressure column, a low pressure column and an argon sidearm column; wherein a crude argon product is produced at the top of the argon sidearm column; wherein at least a portion of crude liquid oxygen produced at the bottom of the high pressure column is fed to a reboiler/condenser located at the top of the argon sidearm column to provide refrigeration for condensing at least a portion of the crude argon thereby providing reflux for the argon sidearm column; wherein a gaseous argon-oxygen containing side stream is removed from an intermediate location of the low pressure column and fed to the bottom of the argon sidearm column for rectification; and wherein the argon sidearm column a liquid phase and a vapor phase are intimately contacted to effectuate mass transfer to and from the liquid and vapor phases; the improvement for the production of low oxygen content argon having an oxygen content of less than or equal to 0.5 mol % directly from the argon side arm column while maximizing argon recovery comprises:

(a) using an argon sidearm column having an effective number of theoretical stages required to produce a particular crude argon product purity without sacrificing argon recovery;

(b) feeding crude liquid oxygen from the bottom of the high pressure column to the reboiler/condenser located in the top of the argon side arm column at a rate in the range from about 1.04 to about 1.36 times the theoretical minimum flow of crude liquid oxygen necessary to completely vaporize that minimum flow of crude liquid oxygen to its dew point; and (c) operating the argon sidearm column so as to achieve a pressure at the top of the argon side arm column such that the flow of crude liquid oxygen to the reboiler/condenser located in the top of the side arm column falls within the range from about 1.04 to about 1.36 times the theoretical minimum flow of crude liquid oxygen necessary to completely vaporize that minimum flow of crude liquid oxygen to its dew point.

2. In a process for the separation of air by cryogenic distillation to produce a crude argon product, wherein the separation is carried out in a multiple distillation column system containing a high pressure column, a low pressure column and an argon sidearm column; wherein a crude argon product is produced at the top of the argon sidearm column; wherein at least a portion of crude liquid oxygen produced at the bottom of the high pressure column is fed to a reboiler/condenser located at the top of the argon sidearm column to provide refrigeration for condensing at least a portion of the crude argon thereby providing reflux for the argon sidearm column; wherein a gaseous argon-oxygen containing side stream is removed from an intermediate location of the low pressure column and fed to the bottom of the argon sidearm column for rectification; and wherein the argon sidearm column a liquid phase and a vapor phase are intimately contacted to effectuate mass transfer to and from the liquid and vapor phases; the improvement for the production of low oxygen content argon directly from the argon side arm column while maximizing argon recovery comprises:

(a) using an argon sidearm column having an effective number of theoretical stages required to produce a particular crude argon product purity without sacrificing argon recovery;

(b) feeding crude liquid oxygen from the bottom of the high pressure column to the reboiler/condenser located in the top of the argon side arm column at a rate in the range from about 1.04 to about 1.36 times the theoretical minimum flow of crude liquid oxygen necessary to completely vaporize that minimum flow of crude liquid oxygen to its dew point; and (c) effectuating the intimate contact between the vapor and liquid phases in the argon side arm column by use of a combination of conventional sieve trays and low pressure drop, structured packing so that pressure drop across the combination results in a pressure at the top of the argon side arm column such that the flow of crude liquid oxygen to the reboiler/condenser located in the top of the side arm column falls within the range from about 1.04 to about 1.36 times the theoretical minimum flow of crude liquid oxygen necessary to completely vaporize that minimum flow of crude liquid oxygen to its dew point.

3. In a process for the separation of air by cryogenic distillation to produce a crude argon product, wherein the separation is carried out in a multiple distillation column system containing a high pressure column, a low pressure column and an argon sidearm column; wherein a crude argon product is produced at the top of the argon sidearm column; wherein at least a portion of crude liquid oxygen produced at the bottom of the high pressure column is fed to a reboiler/condenser located at the top of the argon sidearm column to provide refrigeration for condensing at least a portion of the crude argon thereby providing reflux for the argon sidearm column; wherein a gaseous argon-oxygen containing side stream is removed from an intermediate location of the low pressure column and fed to the bottom of the argon sidearm column for rectification; and wherein the argon sidearm column a liquid phase and a vapor phase are intimately contacted to effectuate mass transfer to and from the liquid and vapor phases; the improvement for the production of low oxygen content argon directly from the argon side arm column while maximizing argon recovery comprises:

(a) using an argon sidearm column having an effective number of theoretical stages required to produce a particular crude argon product purity without sacrificing argon recovery;

(b) feeding crude liquid oxygen from the bottom of the high pressure column to the reboiler/condenser located in the top of the argon side arm column at a rate in the range from about 1.04 to about 1.36 times the theoretical minimum flow of crude liquid oxygen necessary to completely vaporize that minimum flow of crude liquid oxygen to its dew point; and (c) effectuating the intimate contact between the vapor and liquid phases in the argon side arm column by use of low pressure, structured packing and reducing the pressure of the argon/oxygen side stream fed to the argon sidearm column so that the combination of the pressure drop across the low pressure, structured packing and the reduction of pressure of the argon/oxygen side stream fed to the argon sidearm column result in a pressure at the top of the argon side arm column such that the flow of crude liquid oxygen to the reboiler/condenser located in the top of the side arm column falls within the range from about 1.04 to about 1.36 times the theoretical minimum flow of crude liquid oxygen necessary to completely vaporize that minimum flow of crude liquid oxygen to its dew point.

* * * * *